US010317145B2

(12) United States Patent
Bolin

(10) Patent No.: US 10,317,145 B2
(45) Date of Patent: Jun. 11, 2019

(54) DIGITAL HEAT PIPE

(71) Applicant: CLIMATEWELL AB (PUBL), Hägersten (SE)

(72) Inventor: Göran Bolin, Täby (SE)

(73) Assignee: CLIMATEWELL AB, Hagersten (SE)

( * ) Notice: Subject to any disclaimer, the term of this patent is extended or adjusted under 35 U.S.C. 154(b) by 790 days.

(21) Appl. No.: 14/737,732

(22) Filed: Jun. 12, 2015

(65) Prior Publication Data

US 2015/0276322 A1 Oct. 1, 2015

Related U.S. Application Data

(63) Continuation of application No. PCT/EP2013/077567, filed on Dec. 20, 2013.
(Continued)

(30) Foreign Application Priority Data

Dec. 28, 2001 (SE) ..... 1251521
Dec. 28, 2012 (SE) ..... 1251519
(Continued)

(51) Int. Cl.
*F28D 15/02* (2006.01)
*F28D 15/06* (2006.01)
*F28F 13/00* (2006.01)

(52) U.S. Cl.
CPC ..... *F28D 15/02* (2013.01); *F28D 15/0266* (2013.01); *F28D 15/06* (2013.01); *F28F 2013/008* (2013.01)

(58) Field of Classification Search
CPC ..... F28D 15/02; F28D 15/0266; F28D 15/06; F28D 15/0275; F28F 2013/008; F25B 25/00; F25B 2345/001; F25B 2345/002
(Continued)

(56) References Cited

U.S. PATENT DOCUMENTS 1,930,842 A * 10/1933 Paige ..... F28D 1/024 237/12
3,661,202 A 5/1972 Moore, Jr.
(Continued)

FOREIGN PATENT DOCUMENTS

JP S59138895 A1 * 8/1984 ..... F28D 15/00

*Primary Examiner* — Christopher R Zerphey
*Assistant Examiner* — Harry E Arant
(74) *Attorney, Agent, or Firm* — Porter Wright Morris & Arthur LLP

(57) ABSTRACT

A heat pipe comprises a condenser, an evaporator, a working fluid, a displacement vessel and at least one connecting pipe. The volume available for the working fluid inside the displacement vessel is adjustable, said volume being adapted to change by a rotating movement of a body. In one embodiment external heat pipes allow several different heat sources to be connected. Advantages include that the capability of transferring heat can be adjusted and fine tuned to the desired value. Less force is required to rotate the body inside the displacement vessel. No energy input is required to hold the body in a desired position. The construction is simple and inexpensive to manufacture. In particular the construction is easy to manufacture in different volumes, since the diameter of the displacement vessel and rotating body can be the same but with a longer displacement vessel.

19 Claims, 8 Drawing Sheets

Related U.S. Application Data

(60) Provisional application No. 61/748,559, filed on Jan. 3, 2013, provisional application No. 61/748,555, filed on Jan. 3, 2013, provisional application No. 61/748,551, filed on Jan. 3, 2013, provisional application No. 61/748,548, filed on Jan. 3, 2013.

(30) Foreign Application Priority Data

Dec. 28, 2012 (SE) ..... 1251520
Dec. 28, 2012 (SE) ..... 1251522

(58) Field of Classification Search
USPC ..... 165/104.22, 104.21, 104.25, 104.27; 62/149
See application file for complete search history.

(56) References Cited

U.S. PATENT DOCUMENTS

| | | | | |
|---|---|---|---|---|
| 4,413,670 | A * | 11/1983 | Ritter | F25B 17/12 165/104.12 |
| 7,174,950 | B2 * | 2/2007 | Jacque | B64G 1/506 165/104.26 |
| 2012/0031123 | A1 | 2/2012 | Jonsson et al. | |
| 2013/0175008 | A1 * | 7/2013 | Yeh | F28F 13/187 165/104.26 |

* cited by examiner

DIGITAL HEAT PIPE

This application is a continuation of PCT Application No. PCT/EP2013/077567, filed Dec. 20, 2013, which claims benefit of U.S. Provisional Application No. 61/748,548, filed Jan. 3, 2013, U.S. Provisional Application No. 61/748,551, filed Jan. 3, 2013 U.S. Provisional Application No. 61/748,555, U.S. Provisional Application No. 61/748,559, filed Jan. 3, 2013 and priority from Swedish Application No. SE 1251519-3, filed Dec. 28, 2012, Swedish Application No. SE 1251520-1, filed Dec. 28, 2012, Swedish Application No. SE 1251521-9, filed Dec. 28, 2012, and Swedish Application No. SE 1251522-7, filed Dec. 28, 2012, the entire contents of each of which are hereby incorporated by reference.

TECHNICAL FIELD

The present invention relates generally to an improved heat pipe which can be regulated and has extended ability of energy uptake.

BACKGROUND

Generally sorption machines (including adsorption and absorption machines) that are working intermittently use a two-steps process. In the first step the reactor of the sorption machine is heated, this is referred to as the charging step. In the second step, the reactor of the sorption machine is cooled, this is referred to as the discharging step. If the sorption machines consists of multiple unites it is necessary to have good thermal connections to each, also considering a possible temperature difference between different heat sources. A sorption machine (i.e. a chemical heat pump) generally comprises a reactor. In order to bring about good performance to the sorption machine it is essential that the energy delivery, to and from, the reactor of the sorption machine can be obtained without hindrance. For this reason, it is important to have a good thermal contact and conductivity between the media transferring energy to the reactor during heating and the media transporting energy from the reactor during cooling. This is normally achieved by having several valves, pumps and pipes redirecting the transfer media from the reactor of the sorption machine to either a hot or a cool source. This activity consumes parasitic energy and requires investments in piping causing costs. Instead of using pumps, valves and pipes it is also well known that heat pipes can be used for both heating and cooling purposes.

If heat pipes are used in the above mentioned setup it has to be at least two heat pipes both of them in good and permanent contact with the reactor. One heat pipe should be for cooling and the other on should be for heating. Generally, heat pipes work continuously without any possibility to interrupt the process. However, this is not feasible in the above setup since both heat pipes in this case will be constantly working against each other, resulting in a situation where the heat received to the reactor by one of the heat pipes, will then at the same time be taken away by the other heat pipe.

Heat pipes where the heat transfer can be regulated solve this problem. It is also necessary to have extended energy uptake from the thermal transistor. Solutions with heat pipes which can be controlled have been disclosed.

JP59-138895 discloses a switchable heat pipe where the transfer of heat is controlled by a magnetic body movable within the heat pipe. The magnetic body changes the volume of a space where the working fluid of the heat pipe can be stored. When the working fluid is in the storage space it does not participate in heat transfer. The magnetic body is controlled by a magnet and is moving up or down in the space to change the volume.

Problems in the prior art include that a force which is not negligible has to be used to control the moving body. Thus it is desirable to reduce the force and energy which has to be used to control a switchable heat pipe.

Another problem in the prior art is that the disclosed solution is most suitable for a heat pipe which only has to be switched on and off. A continuous regulation of the heat transfer capacity of heat pipe would be difficult using the approach disclosed in the prior art. Thus it is a problem how to provide a heat pipe where the usable volume of the working fluid can be changed continuously to the desired volume.

A further problem in the prior art is that the construction does not easily allow a heat pipe which can be manufactured in different sizes at an industrial scale.

Yet another problem in the prior art is that several heat sources with different temperatures or slightly different temperatures cannot easily be connected to the same heat pipe.

SUMMARY

It is an object of the present invention to obviate at least some of the disadvantages in the prior art and provide an improved heat pipe which can be regulated.

In a first aspect there is provided a heat pipe, being a closed system and comprising a condenser 1, an evaporator 2, and a working fluid 4, wherein the condenser 1 and the evaporator 2 are connected to a displacement vessel 3 with at least one pipe 7, wherein the heat pipe further comprises a space 3*b* in the displacement vessel 3, wherein the volume available for the working fluid 4 in liquid state inside the space 3*b* is adjustable, said space 3*b* being adapted to shift between one first available volume V1 and at least one second smaller available volume V2, wherein the condenser 1 is situated above the space 3*b* in relation to the gravitational force and the evaporator 2 is situated below the space 3*b* in relation to the gravitational force, wherein the heat pipe is adapted so that working fluid 4 in liquid state can flow under influence of gravitational force from the condenser 1 via the displacement vessel 3 to the evaporator 2, wherein the a body 5 is adapted for a rotating movement inside the displacement vessel 3 and is adapted to have a first position P1 so that the space 3*b* has the first available volume V1, and wherein the body 5 further is adapted for a rotating movement to at least one second position P2 so that the space 3*b* has the smaller second available volume V2.

Further aspects and embodiments are defined in the appended claims, which are specifically incorporated herein by reference.

One advantage is that the heat pipe can be controlled accurately and in a simple way. The heat pipe can be switched on or off according to convenience, and the heat pipe can further be regulated so that its capability of transferring heat can be adjusted and fine tuned to the desired value.

In particular less force is required to rotate the body inside the displacement vessel compared to the prior art where a body is pushed down into the displacement vessel. No energy input is required to hold the body 5 in a desired position.

It is easy to adjust the volume of the displacement vessel so that the heat transfer capability of the heat pipe can be fine-tuned to a desired value. This is accomplished by rotating the body a little bit so that the desired volume is obtained. The amount of working fluid available for heat transfer can thus be precisely controlled.

Another advantage is that the construction is simple and inexpensive to manufacture. In particular the construction is easy to manufacture in different sizes, since the diameter of the displacement vessel and rotating body can be the same. This allows the same tools to be used during manufacture. Only the length of the cylindrical displacement vessel and rotating body have to be adjusted. Thus different heat pipes with different volumes can be manufactured with the same diameter of the displacement vessel, which would simplify the manufacturing process and give a less expensive process.

One advantage of an embodiment is that several heat sources can be connected to one controllable heat pipe. When several heat sources needs to be regulated (on, off, or analog in between) at the same time the cost for this can be low due to that the device has ability to connect thermally to many sources using only one moving mechanism.

Another advantage is that the rotating device (the body 5) always can be kept at a constant distance from a magnet rotating the body meaning that the power of magnetism does not vary when the length of the stroke varies.

One advantage is when the heat pipe is connected via a number of external heat pipes to a number of different heat sources, if the entire block has to be turned off due to for instance a technical fault or similar, the block can easily be turned off.

Another advantage is when the heat pipe is connected via a number of external heat pipes to a number of different heat sources, then it is only necessary to have one switching and regulating mechanism for everything which gives a simpler and less expensive system.

Another advantage is that the entire thermal transistor can be adapted to transfer different powers to the heat pipe from different heat sources.

The turning unit is totally scalable and can regulate large or small power.

BRIEF DESCRIPTION OF THE DRAWINGS

The invention is now described, by way of example, with reference to the accompanying drawings, in which.

DETAILED DESCRIPTION

Figure 1A:
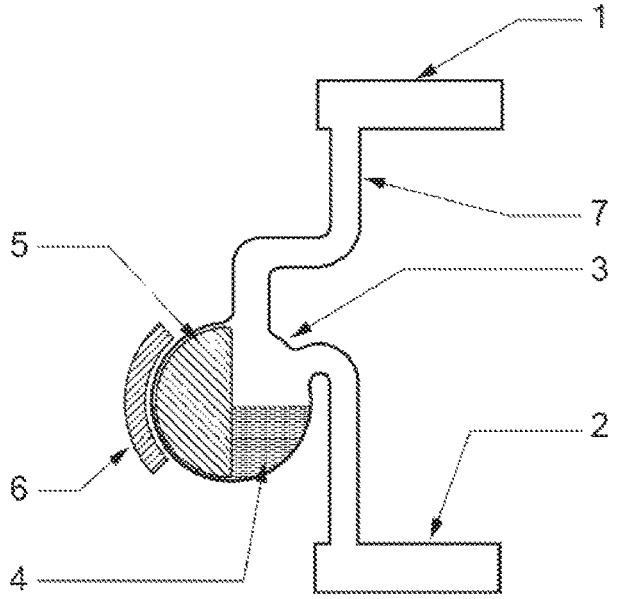
FIG. 1*a* shows an embodiment of a heat pipe with a rotating body when the heat pipe is switched off, where all working fluid 4 is in in the displacement vessel 3.

Before the invention is disclosed and described in detail, it is to be understood that this invention is not limited to particular compounds, configurations, method steps, substrates, and materials disclosed herein as such compounds, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms “a”, “an” and “the” include plural referents unless the context clearly dictates otherwise.

If nothing else is defined, any terms and scientific terminology used herein are intended to have the meanings commonly understood by those of skill in the art to which this invention pertains.

The heat pipe is closed so that for instance vapor does not escape from the system when energy is transferred to the evaporator. This does not rule out the existence of some kind of safety valve, which is adapted to release if the pressure becomes too high in order to protect the heat pipe from physical damage.

The heat pipe is intended to work under influence of gravitational force and thus the direction of the heat pipe in relation to the gravitational force is important. Upper and lower as well as above and below are defined in the direction of the gravity force so that lower and below are in the direction in which the gravity force acts.

In a first aspect there is provided a heat pipe, being a closed system and comprising a condenser 1, an evaporator 2, and a working fluid 4, wherein the condenser 1 and the evaporator 2 are connected to a displacement vessel 3 with at least one pipe 7, wherein the heat pipe further comprises a space 3*b* in the displacement vessel 3, wherein the volume available for the working fluid 4 in liquid state inside the space 3*b* is adjustable, said space 3*b* being adapted to shift between one first available volume V1 and at least one second smaller available volume V2, wherein the condenser 1 is situated above the space 3*b* in relation to the gravitational force and the evaporator 2 is situated below the space 3*b* in relation to the gravitational force, wherein the heat pipe is adapted so that working fluid 4 in liquid state can flow under influence of gravitational force from the condenser 1 via the displacement vessel 3 to the evaporator 2, wherein the a body 5 is adapted for a rotating movement inside the displacement vessel 3 and is adapted to have a first position P1 so that the space 3*b* has the first available volume V1, and wherein the body 5 further is adapted for a rotating movement to at least one second position P2 so that the space 3*b* has the smaller second available volume V2.

It is understood that in one embodiment the body 5 is adapted to rotate and stay at any desired position so that the available volume 3*b* inside the displacement vessel 3 has the desired value.

In one embodiment the space 3*b* is adapted to have a first available volume V1 which equals or exceeds the volume of working fluid (4) in the heat pipe, and wherein the space 3*b* is adapted to have at least one second smaller available volume V2 which is smaller than the volume of working fluid 4 in the heat pipe.

In one embodiment the body 5 comprises at least one magnet, and wherein at least one magnet 6 is adapted for achieving a rotating movement of the body 5. In one embodiment the magnet 6 is an external magnet. In one embodiment the magnet 6 is at least one selected from the group consisting of an electro magnet and a permanent magnet. In one embodiment one moving external magnet 6 is placed outside the heat pipe in order to rotate the body 5. The body 5 can have many different shapes. In one embodiment the external magnet 6 is driven by an electric motor. In one embodiment the external magnet 6 is positioned on an arm with the ability to rotate approximately 180°.

In one embodiment at least a part of the inside of the displacement vessel 3 has cross section which is at least partly circular, wherein the outside of the body 5 has a cross section which is at least partly circular, wherein the diameter of the circular cross section of the displacement vessel 3 is adapted so that the diameter of the circular cross section of the body 5 fits into the displacement vessel 3. In one embodiment the displacement vessel 3 is shaped as a cylinder.

In one embodiment the evaporator 2 comprises an evaporation zone e1, wherein the evaporation zone e1 is in thermal contact with the condenser part of an external heat pipe eh.

In one embodiment the evaporator 2 comprises at least two different evaporation zones e1, e2, wherein each of the evaporation zones e1, e2 is in thermal contact with at least one condenser part of an external heat pipe eh, h2.

In one embodiment at least one evaporation zone e1, e2 displays a net attractive force with respect to the working fluid 4.

In one embodiment at least one external heat pipe is adapted to transfer heat from the reactor part of a chemical heat pump working in a two-step process. In one embodiment said chemical heat pump working in a two-step process is heated by a heat source. Examples of heat sources include but are not limited to the sun, a gas heater, an oil burner, an electrical heater, a coal fired furnace, and a wood fired furnace.

In one embodiment the condenser 1 is connected to a user of the heat. Examples of users of the heat include but are not limited to a hot water tank and a heating system for buildings.

In a second aspect there is disclosed a method of operating a heat pipe described above, wherein the volume of the space with adjustable available volume 3*b* is decreased or increased by a rotating movement of the body 5, in order to increase or decrease respectively the heat transfer capacity the heat pipe.

In one embodiment the body 5 is rotated with a magnet 6.

In one embodiment wherein at least one external heat pipe is adapted to transfer heat from the reactor part of a chemical heat pump working in a two-step process, the heat transfer of the heat pipe is reduced or turned off when the chemical heat pump working in a two-step process is charged by en external energy source.

The working fluid 4 evaporates in the evaporator 2 and is transferred to gas phase. When the working fluid 4 in gas phase reaches the condenser 1 it is cooled and becomes liquid, where after it flows in liquid state down to the displacement vessel 3 and further down to the condenser, provided that the body 5 is adjusted so that the heat pipe is on, i.e. that it transfers heat.

The working fluid 4 is in one embodiment a working fluid which is commonly used in heat pipes. Examples of working fluids include but are not limited to water, an alcohol, anhydrous ammonia, and propylene.

In one embodiment the space 3*b* is adapted to have a first available volume V1 which equals or exceeds the volume of working fluid 4 in the heat pipe, and wherein the space 3*b* is adapted to have at least one second smaller available volume V2 which is smaller than the volume of working fluid 4 in the heat pipe.

In this context the volume of working fluid 4 refers to the volume of working fluid when it is in liquid state.

In general it is intended that the displacement vessel 3 has a temperature at which the working fluid 4 is in liquid state. The working fluid in gas phase can pass the displacement vessel 3 on its way up to the condenser 1.

The space 3*b* in the displacement vessel 3 is the lower part of the displacement vessel 3. The pipe 7 leading from the evaporator 2 to the displacement vessel 3 is connected to the displacement vessel at a level which defines the volume of the space 3*b*, if the volume of liquid working fluid 4 in the space 3*b* exceeds the available volume in the space 3*b* the working fluid 4 flows down to the evaporator. Thus the space 3*b* is situated lower than the connection in the vessel 3 to the pipe 7 leading to the evaporator.

The condenser 1 is situated higher in relation to the gravitational force than the space 3*b*, and the space 3*b* in turn is situated higher than the evaporator 2. This allows the possibility for a flow of liquid from the condenser 1 to the evaporator 2, when the available volume in the space 3*b* is small, i.e. V2.

The space 3*b* can have a first volume V1 where all or essentially all working fluid 4 is held in liquid state in the space 3*b*. This does not rule out the equilibrium distribution between working fluid in liquid phase and gas phase in the system. The space 3*b* can also be adjusted by different means so that the volume available to the working fluid becomes V2, which is smaller than V1, so that a portion of the working fluid 4 flows down in the evaporator and the heat pipe starts working. The space 3*b* has an adjustable volume, so that different amounts of working fluid 4 enter the loop of the heat pipe.

In one embodiment the space 3*b* is adapted to have a first available volume V1 which equals or exceeds the volume of working fluid 4 in the heat pipe, and wherein the space 3*b* is adapted to have a second smaller available volume V2 which is smaller than the volume of working fluid 4 in the heat pipe.

It is understood that the displacement vessel 3 should not be heated to any significant extent by the heat source which heats the evaporator 2. The working liquid 4 in the displacement vessel should not be heated and evaporate to any noticeable extent.

The existence of a first available volume V1 and at least one second smaller available volume V2 also implies that the heat transfer capacity can be regulated. A continuous regulation is encompassed, since the number of different volumes V2 can be very large. Thus the volume can be decreased from a volume V1 continuously over a very large or infinite number of volumes V2. In particular it is an advantage that the rotating motion of the body 5 facilitates a step less change of the volume of the space 3*b*.

In one embodiment the body 5 is magnetic and the rotating movement is achieved with a magnet 6 outside the displacement vessel 3. The rotating movement means that a varying volume of the body 5 is in the part of the displacement vessel 3 which is denoted as the space 3*b* and thereby can displace a varying amount of liquid. The amount of liquid in the space 3*b* can thus be controlled by the angle of rotating movement of the body 5. In one embodiment the body 5 comprises at least one magnet, and wherein a magnet 6 is adapted for achieving a rotating movement of the body 5. In one embodiment the magnet 6 is a moving permanent magnet outside the displacement vessel. In yet another embodiment the magnet 6 is at least one electromagnet outside the displacement vessel. Also combinations of permanent magnets and electromagnets are encompassed. An advantage of control with a magnet compared to a mechanical connection is that the entire system including the displacement vessel 3 can be completely sealed.

In one embodiment the body 5 is adapted so that it will block the at least one pipe 7 when the heat pipe is switched off, i.e. when the space 3*b* has the one first volume V1.

In one embodiment the evaporator 2 comprises at least two different areas e1, e2 inside the evaporator, wherein each of the at least two different areas e1, e2 inside the evaporator is in thermal contact with at least one heat source.

In one embodiment there are a number of different areas on the inside surface of the evaporator 2 of the heat pipe. Non limiting examples of numbers of different areas include but are not limited to 2, 3, 4, 5, 10, 15, 18, 20, 30, 60 different areas inside the evaporator.

In one embodiment at least one of said at least one heat source is the condenser part of an external heatpipe eh, said external heat pipe eh comprising a working fluid and an evaporator part. It is understood that such an external heat pipe eh is a conventional heat pipe being a closed tube comprising an evaporator part, a condenser part, and a working fluid. It is understood that a number of different external heat pipes eh can be connected to the heat pipe of the invention. Non limiting examples of numbers of different external heat pipes eh which are connected to the heat pipe include but are not limited to 2, 3, 4, 5, 10, 15, 18, 20, 30, 60 different external heat pipes eh.

In one embodiment at least one of said at least two different areas e1, e2 inside the evaporator displays a net attractive force with respect to the working fluid 4. The net attractive force for the working fluid has the effect of attracting working fluid which has condensed in the condenser part and is flowing back to the evaporator part of the heat pipe. Both the area of the different areas e1 e2 and the attractive force can be adjusted. This is a way of regulating the way the condensed working fluid is distributed between the different areas. Thus it is an advantage that the liquid working fluid flowing back to the evaporator can be distributed in a controlled way between the different areas e1 e2 etc. In one embodiment the area of the different areas e1 e2 etc are adjusted. In an alternative embodiment the attraction of the different areas e1 e2 etc with respect to the working fluid is adjusted. In yet another embodiment both the area and the attraction are adjusted. This is a way of controlling the flow of working fluid 4 from the condenser 2 back to the evaporator.

In one embodiment at least one of said at least two different areas e1, e2 inside the evaporator is at least partially hydrophilic. This is intended to work with for instance aqueous working fluids so that there is an attraction of the working fluid to hydrophilic areas of the evaporator.

In one embodiment the condenser part of at least one external heat pipe (eh) displays a net repulsive force with respect to the working fluid in the at least one external heat pipe (eh). It is understood that the inner surface of the condenser of an external heat pipe repels the working fluid used in that particular external heat pipe. The condenser part of the external heat pipe eh is in thermal contact with an area of the evaporator 2 of the heat pipe.

The heat pipe according to claim 12, wherein the condenser part of at least one external heat pipe (eh) is hydrophobic.

In one embodiment at least one of said at least two different areas e1, e2 inside the evaporator 2 comprises a porous material adapted to absorb working fluid 4 in liquid phase and adapted to release working fluid 4 in gas phase. In one embodiment the porous material comprises glass fiber. It is intended that the working fluid 4 is condensed in the condenser and flows back to the evaporator 2. In the evaporator it is attracted to the porous material, whereby the working fluid is heated by the heat source (such as a heat pipe) in thermal contact with the area.

In one embodiment at least one external heat pipe eh is adapted to transfer heat from the reactor part of a chemical heat pump, said heat pump working in a two-step process. It is conceived that for instance two or more different chemical heat pumps working in two step processes can be connected to the heat pipe. In one embodiment said chemical heat pump working in a two-step process is heated by a heat source. Examples of heat sources include but are not limited to the sun, a gas heater, an oil burner, an electrical heater, a coal fired furnace, and a wood fired furnace.

Description of a First Embodiment

Figure 1B:
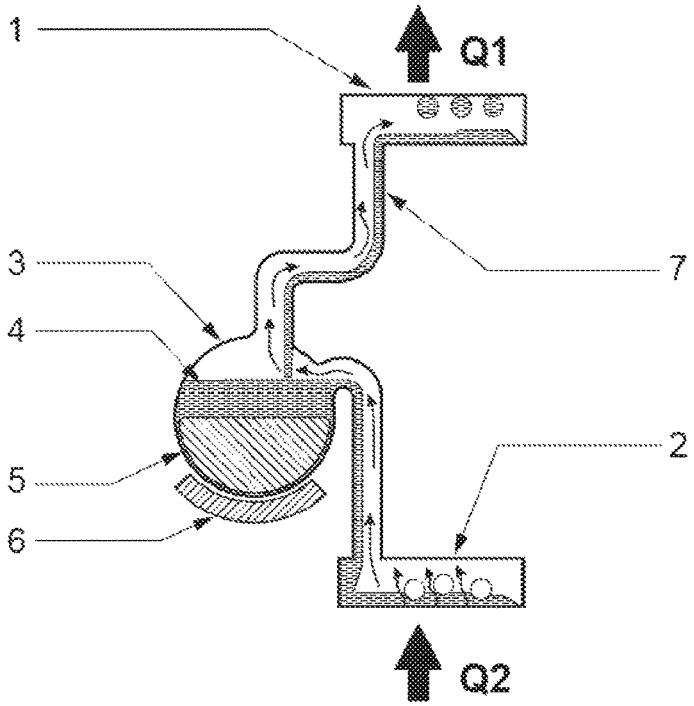
FIG. 1*b* shows the same embodiment as in FIG. 1*a* in when the heat pipe is switched on. A fraction of the working fluid 4 takes part in the heat transfer.
Figure 2A:
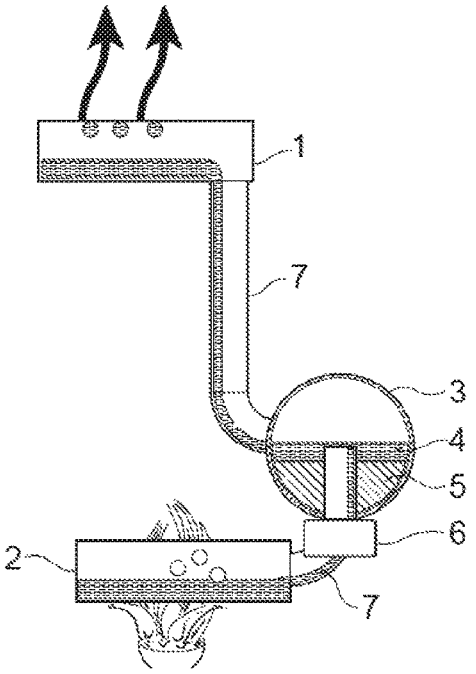
FIG. 2*a* shows one embodiment of the heat pipe with a rotating body where the heat pipe is switched on. The displacement vessel 3 has a circular cross section. The tube 7 leading down to the evaporator 2 is just below the surface of the working fluid 4 in the displacement vessel 3 and thus working fluid 4 is flowing down to the evaporator 2. An external magnet 6 is adapted to rotate the body 5.
Figure 2B:
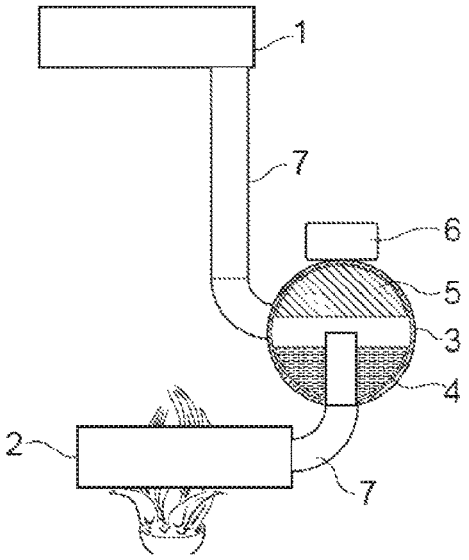
FIG. 2*b* shows the same embodiment as in FIG. 2*a* where the heat pipe is switched off. The tube leading down to the evaporator is above the surface of the working fluid in the displacement vessel and thus working fluid is not able to flow down to the evaporator. The body has been rotated to a position about 180° from the position in FIG. 2*a*.
Figure 3:
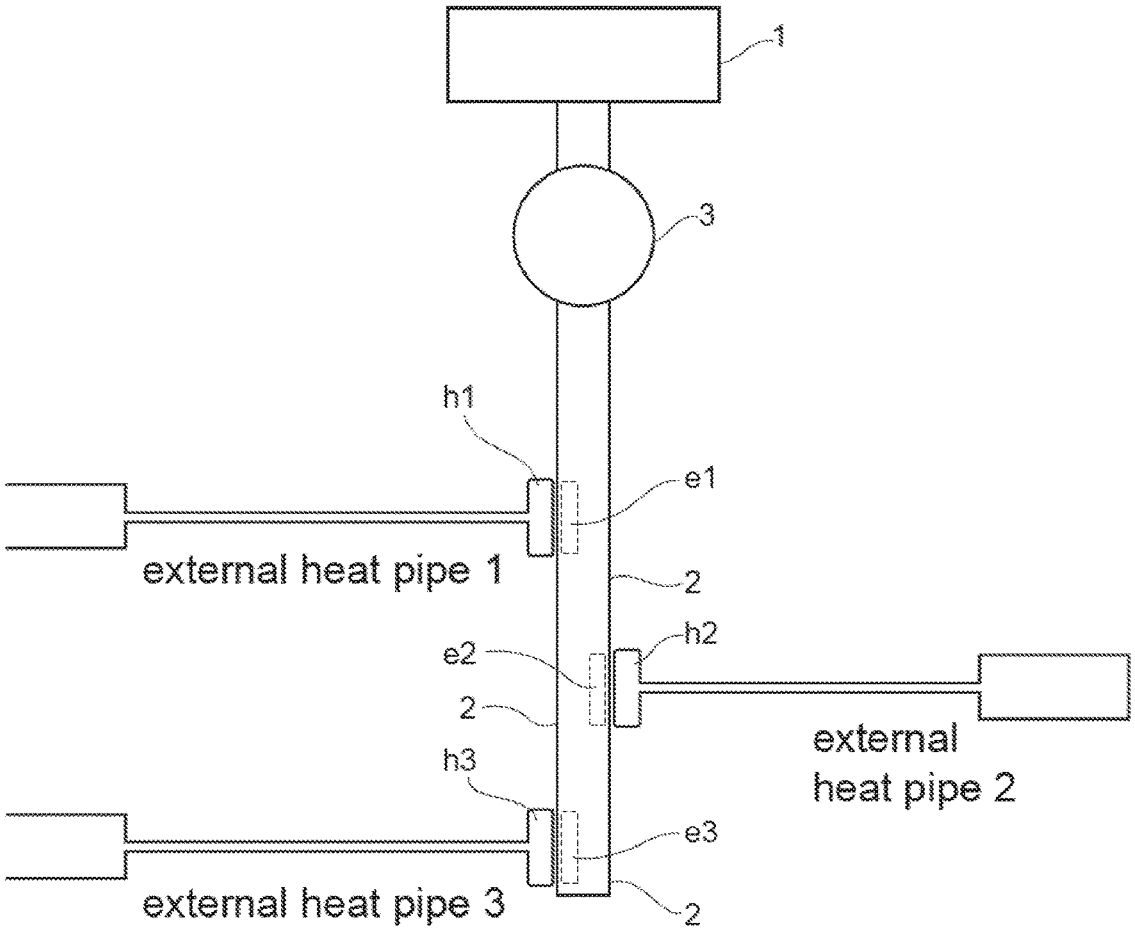
FIG. 3 shows an embodiment of the heat pipe with a condenser 1, evaporator 2 and displacement vessel 3. The evaporator is in thermal contact with three external heat pipes 1-3. In particular the condenser parts h1, h2, and h3 of the external heat pipes 1, 2, and 3 are in thermal contact with the evaporator 2. In particular the condenser parts h1-h3 of the external heat pipes are in thermal contact with different areas e1-e3 respectively in the condenser 2. The areas e1, e2, and e3 on the inside of the heat pipe in the condenser 2 have a surface which attracts the working fluid 4 of the heat pipe. In this particular embodiment the working fluid 4 is aqueous and the areas e1, e2, and e3 have hydrophilic surfaces.
Figure 4:
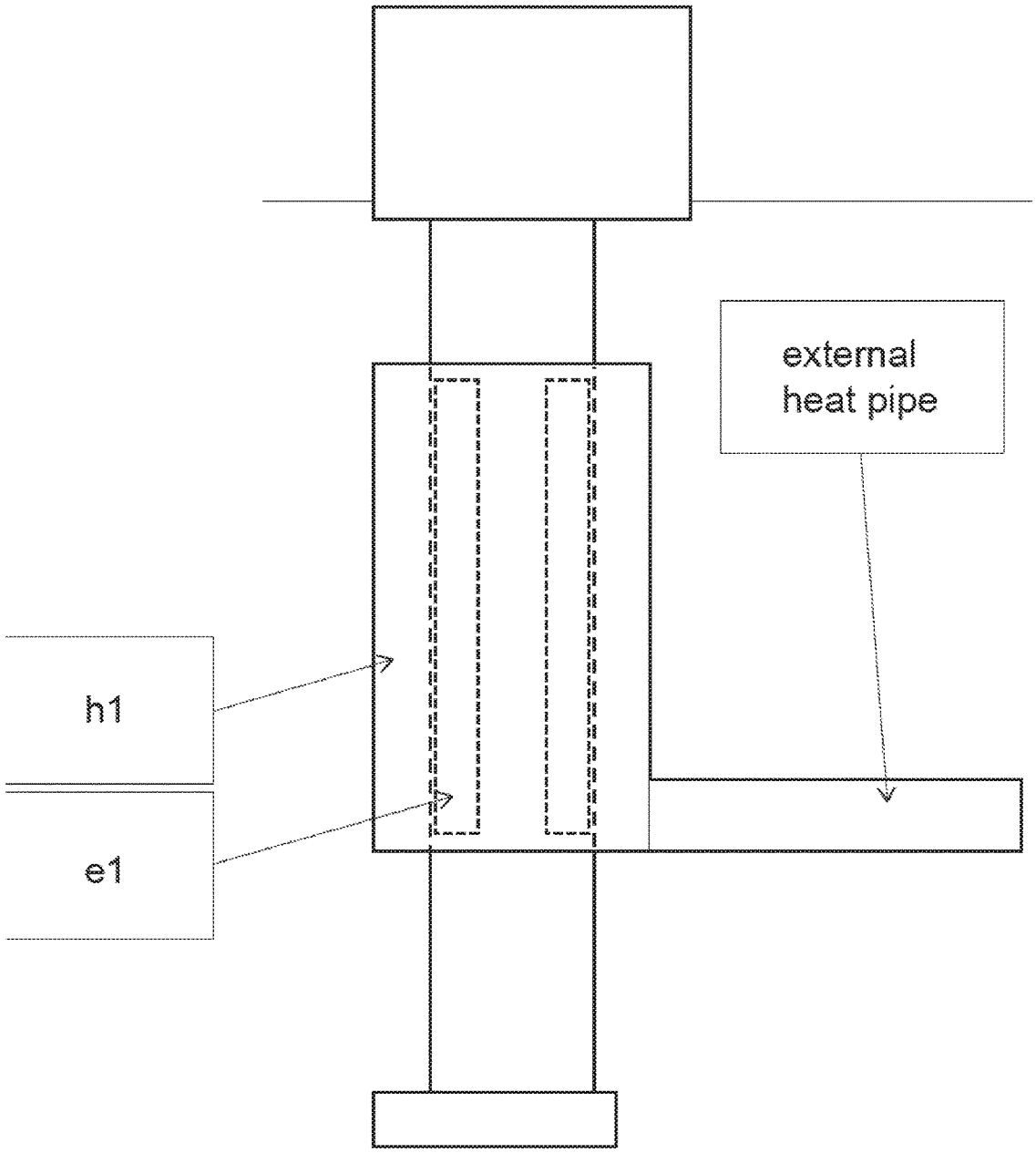
FIG. 4 shows a detailed view of the connection between one external heat pipe and the heat pipe (main heat pipe). In this particular embodiment the condenser part h1 of the external heat pipe surrounds the heat pipe. Heat is transferred from h1 to e1. E1 is the area on the inside of the heat pipe in the condenser 2 and has a surface which attracts the working fluid 4 of the heat pipe. E1 also has a porous structure which attracts working fluid 4. Working fluid 4 in liquid state will flow down in the heat pipe and be attracted to the porous e1 area. The working fluid will be heated and evaporate.

The heat pipe is now described more in detail by giving an example of a non limiting embodiment, referring to FIGS. 1*a* and 1*b* in which 1 denotes the condenser, 2 evaporator, 3 displacement vessel, 4 working fluid, 5 floating body with magnet, 6 magnet, and 7 pipes for transport of working fluid in gas phase and in liquid phase. Q1 and Q2 denote energy transferred from the condenser and energy transferred to the evaporator respectively. The condenser 1 is located in the upper part and it is represented as vessel where the vapor condensates. The evaporator 2 is situated in the lower part; here heat is applied to the surface area generating evaporation of the working fluid. The third part is the displacement vessel 3 in which the Working fluid 4 is stored when the heat pipe is in off-mode. More in detail the working fluid 4 is stored in the lower part of the displacement vessel which is denoted 3*b*. The space 3*b* is in this particular embodiment the lower part of the displacement vessel 3, from the bottom up to the lowest connection to the pipe leading to the evaporator. In the off-mode all the working liquid 4 is stored in the displacement vessel 3 preventing the liquid to return to the evaporator. A rotating body 5 that comprises a magnetic material is used for the regulating function. In this particular embodiment a permanent magnet 6 placed outside the displacement vessel 3 is utilized to rotate the body 5 inside the displacement vessel 3. In this embodiment the displacement vessel 3 is cylindrical and thus has a circular cross cut of its wall. The body 5 has a cross cut which is partly circular. The outer diameter of the circular cross cut of the body 5 is adapted to the inner diameter of the cross cut of the displacement vessel 3 so that the body 5 can rotate inside the displacement vessel 3. There is a small distance between the outer wall of the body 5 and the inner wall of the displacement vessel 3 to allow a rotating movement. The body 5 rotates around a pivot point centered in the circular cross section.

In the on-mode, the permanent magnet 6 is moved so that the body 5 is rotated to a position where it displaces working fluid 4 from the displacement vessel 3 causing the working liquid 4 to flow to the evaporator 2. In the evaporator 2 heat is applied causing the liquid to evaporate. The vapor will then travel all the way up to the condenser 1 through the vapor and liquid transport pipe 7 where it will condense releasing heat to the outer media. Finally, the condensed working fluid in liquid state flows freely through the vapor and liquid transport pipe 7 back to the evaporator 2 where the process continue with boiling and evaporation etc.

Description of a Second Embodiment

Figure 5:
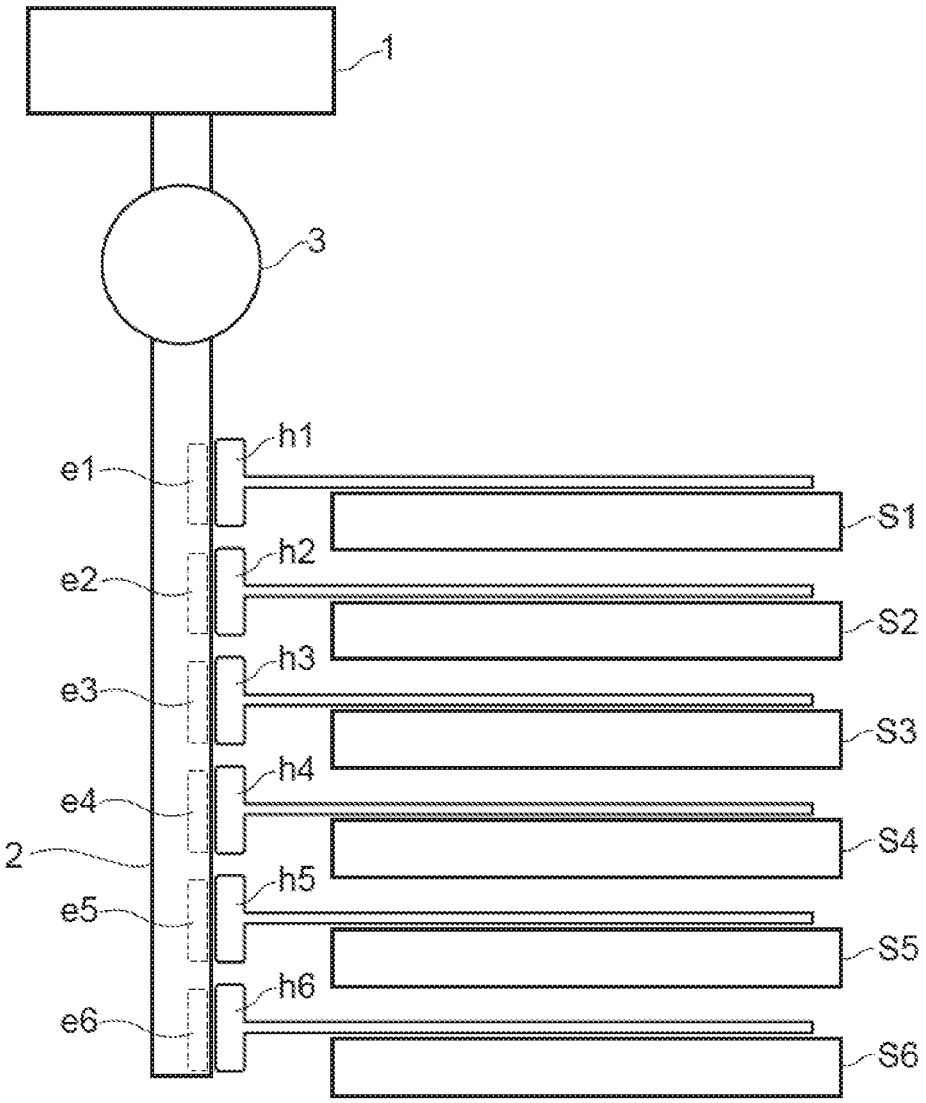
FIG. 5 shows an embodiment with a condenser 1, an evaporator 2 and a displacement vessel 3. The evaporator is in thermal contact with the condenser parts h1-h6 of six external heat pipes. The condenser parts are in thermal contact with six different areas e1-e6 inside the evaporator. The external heat pipes 1-6 are conventional heat pipes leading heat from the heat sources s1-s6.

The heat pipe is now described more in detail by giving an example of a non-limiting embodiment, referring to FIG. 5. To the heat pipe and in particular the evaporation zones e1-e6 of the heat pipe, external heat pipes are thermally connected. The condenser parts of the external heat pipes h1-h6 are in thermal contact with the evaporation zones e1-e6 respectively. The external heat pipes are in thermal contact with different chemical heat pumps working in a two-step process comprising charging and discharging. The chemical heat pumps are adapted to be charged by any heat source. Examples of heat sources include but are not limited to the sun, a gas heater, an oil burner, an electrical heater, a coal fired furnace, and a wood fired furnace. During discharge, heat can be transferred via the external heat pipes to the heat pipe and further to a desired destination. While the chemical heat pumps are charged by the heat source, the heat transfer is switched off by the switch, see FIG. 5.

Description of a Third Embodiment

Figure 6:
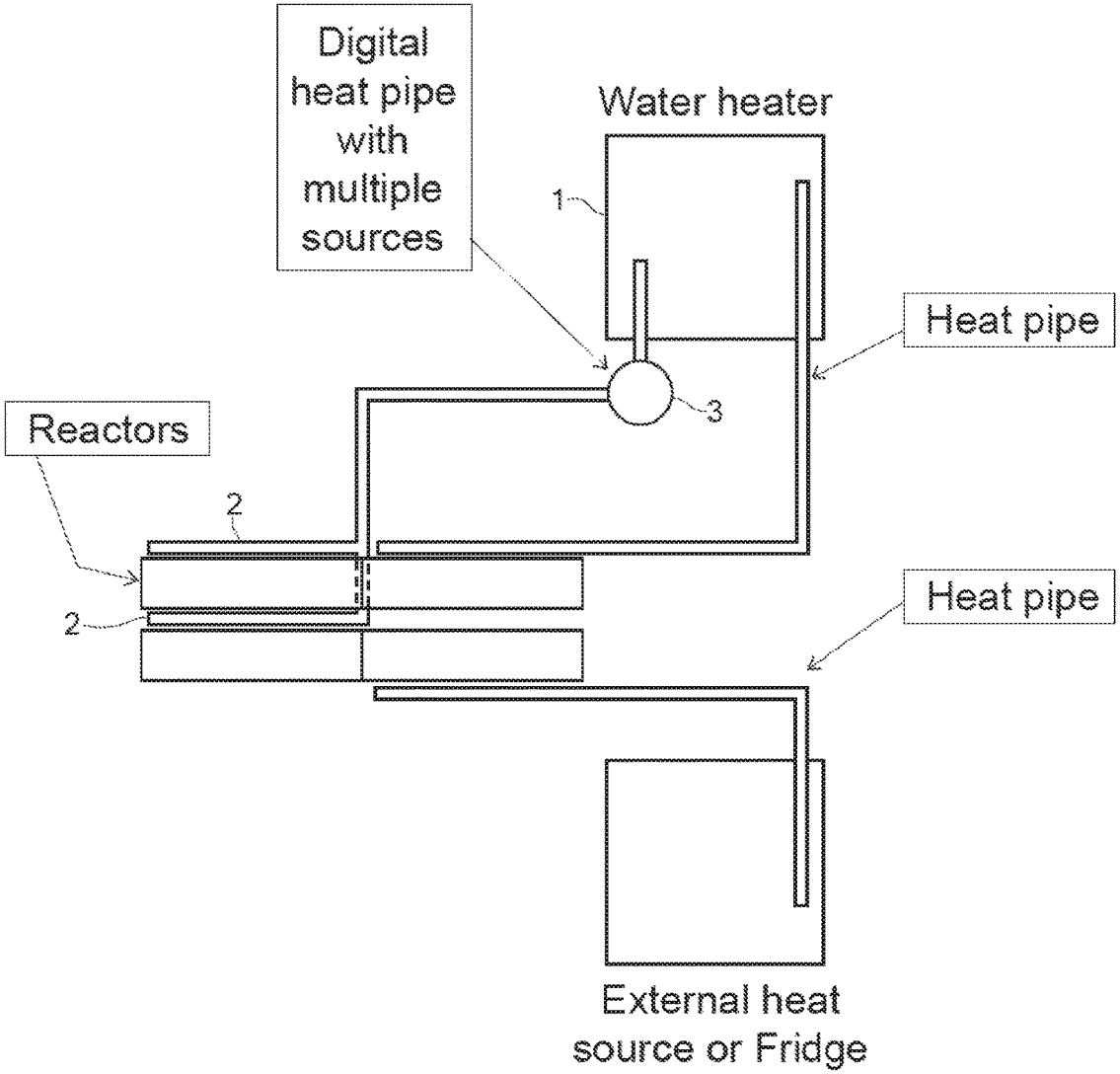
FIG. 6 shows an embodiment with two chemical heat pumps, a condenser 1 inside a water heater, a condenser 2 in thermal contact with the two chemical heat pumps. There is further the displacement vessel 3. A conventional heat pipe leads heat from a heat source to the chemical heat pumps.

The heat pipe is now described more in detail by giving an example of a non limiting embodiment, referring to FIG. 6. From two chemical heat pumps each working in a two-step process and each comprising a reactor part, two heat pipes are adapted to transfer heat to a water heater. One heat pipe is according to the present invention and can be regulated and switched on and off. Heat is also transferred from an external heat source to one of the reactors, see FIG. 6.

Description of a Fourth Embodiment

Figure 7:
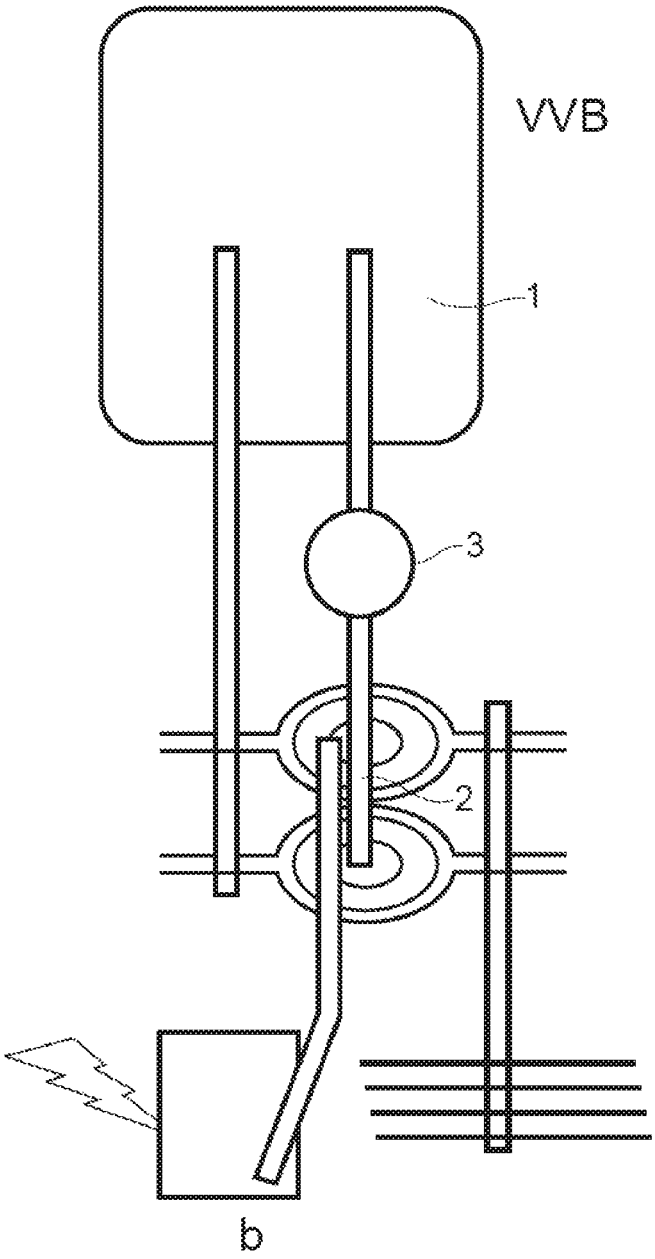
FIG. 7 shows a condenser part 1, a displacement vessel 3, an evaporator 2. B denotes a heat source.
Figure 8:
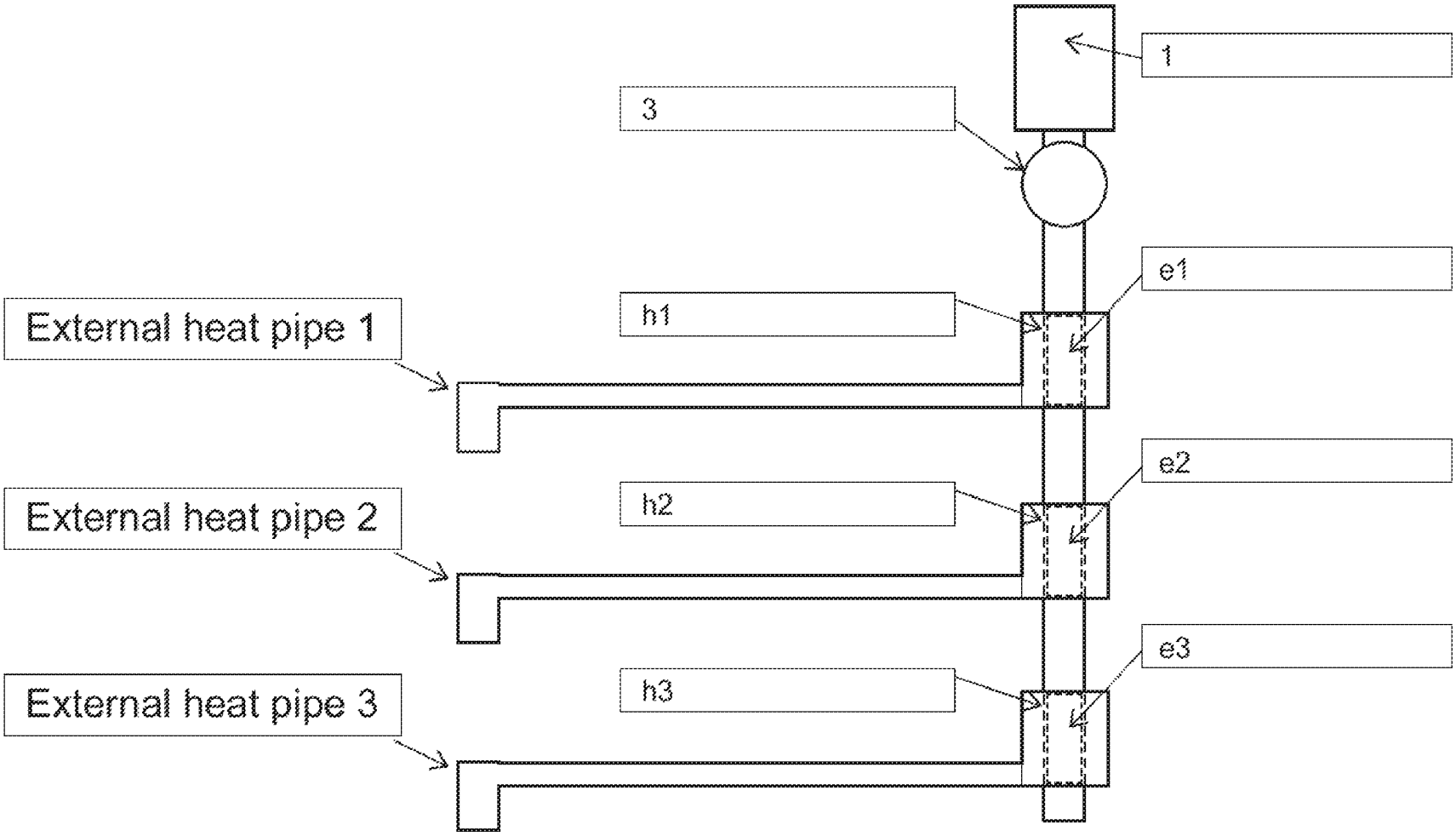
FIG. 8 shows an embodiment of the heat pipe with a condenser 1, evaporator and displacement vessel 3. The evaporator is in thermal contact with three external heat pipes 1-3. In particular the condenser parts h1, h2, and h3 of the external heat pipes 1, 2, and 3 are in thermal contact with the evaporator. In particular the condenser parts h1-h3 of the external heat pipes are in thermal contact with different areas e1-e3 respectively in the condenser 2. The areas e1, e2, and e3 on the inside of the heat pipe in the condenser 2 have a surface which attracts the working fluid 4 of the heat pipe. In this particular embodiment the working fluid 4 is aqueous and the areas e1, e2, and e3 have hydrophilic surfaces.

The heat pipe is now described more in detail by giving an example of a non limiting embodiment, referring to FIG. 7. From two chemical heat pumps each working in a two-step process and each comprising a reactor part and a condenser part, one controllable heat pipe according to the present is adapted to transfer heat from the reactor to the hot water tank VVB. A conventional heat pipe is adapted to transfer heat from the condenser part(s) of the chemical heat pump(s) to the hot water tank WB. Another conventional heat pipe is adapted to transfer heat from a heat source to the condenser part of the chemical heat pump. Yet another conventional heat pipe is adapted to transfer heat from a burner and/or electrical heater to the reactor part of the chemical heat pump. During charging of the chemical heat pump heat is transferred form the burner to the reactor with the controllable heat pipe switched off. For an additional energy input the burner can also be operated when the controllable heat pipe is switched on. See FIG. 7.

Other features and uses of the invention and their associated advantages will be evident to a person skilled in the art upon reading the description and the examples.

It is to be understood that this invention is not limited to the particular embodiments shown here. The embodiments are provided for illustrative purposes and are not intended to limit the scope of the invention since the scope of the present invention is limited only by the appended claims and equivalents thereof.

The invention claimed is:

1. A heat pipe, being a closed system and comprising a condenser, an evaporator, and a working fluid, wherein the condenser and the evaporator are connected to a displacement vessel with at least one pipe, wherein the heat pipe further comprises a space in the displacement vessel, wherein the volume available for the working fluid in liquid state inside the space is adjustable, said space being adapted to shift between one first available volume (V1) and at least one second smaller available volume (V2), wherein the condenser is situated above the space in relation to the gravitational force and the evaporator is situated below the space in relation to the gravitational force, wherein the heat pipe is adapted so that working fluid in liquid state can flow under influence of gravitational force from the condenser via the displacement vessel to the evaporator, wherein a body is adapted for a rotating movement inside the displacement vessel and is adapted to have a first position (P1) so that the space has the first available volume (V1), and wherein the body further is adapted for a rotating movement to at least one second position (P2) so that the space has the smaller second available volume (V2) and, wherein the heat pipe comprises at least one magnet, wherein the at least one magnet is movable for achieving the rotating movement of the body, and wherein the magnet is an external magnet.

2. The heat pipe according to claim 1, wherein the space is adapted to have a first available volume (V1) which equals or exceeds the volume of working fluid in the heat pipe, and wherein the space is adapted to have at least one second smaller available volume (V2) which is smaller than the volume of working fluid in the heat pipe.

3. The heat pipe according to claim 1, wherein the magnet is at least one selected from the group consisting of an electro magnet and a permanent magnet.

4. The heat pipe according to claim 1, wherein at least a part of the inside of the displacement vessel has cross-section which is at least partly circular, wherein the outside of the body has a cross-section which is at least partly circular, wherein the diameter of the circular cross-section of the displacement vessel is adapted so that the diameter of the circular cross-section of the body fits into the displacement vessel.

5. The heat pipe according to claim 1, wherein the displacement vessel is shaped as a cylinder.

6. The heat pipe according to claim 1, wherein the evaporator comprises at least two different areas inside the evaporator, wherein each of the at least two different areas inside the evaporator is in thermal contact with at least one heat source.

7. The heat pipe according to claim 6, wherein at least one of said at least one heat source is the condenser part of an external heat pipe (eh), said external heat pipe (eh) comprising a working fluid and an evaporator part.

8. The heat pipe according to claim 6, wherein at least one of said at least two different areas inside the evaporator displays a net attractive force with respect to the working fluid.

9. The heat pipe according to claim 8, wherein at least one of said at least two different areas inside the evaporator is at least partially hydrophilic.

10. The heat pipe according to claim 7, wherein the condenser part of the external heat pipe (eh) displays a net repulsive force with respect to the working fluid in the external heat pipe (eh).

11. The heat pipe according to claim 10, wherein the condenser part of the external heat pipe (eh) is hydrophobic.

12. The heat pipe according to claim 6, wherein at least one of said at least two different areas inside the evaporator comprises a porous material adapted to absorb working fluid in liquid phase and adapted to release working fluid in gas phase.

13. The heat pipe according to claim 7, wherein the external heat pipe (eh) is adapted to transfer heat from a reactor part of a chemical heat pump, said heat pump working in a two-step process.

14. The heat pipe according to claim 7, wherein the external heat pipe (eh) is adapted to transfer heat from a reactor of a chemical heat pump, said heat pump working in a two-step process, and wherein said chemical heat pump working in a two-step process is heated by a heat source.

15. The heat pipe according to claim 1, wherein the condenser is connected to a user of the heat.

16. A method of operating a heat pipe according to claim 1, wherein the volume of the space with adjustable available volume is decreased or increased by the rotating movement of the body, in order to increase or decrease respectively the heat transfer capacity of the heat pipe.

17. The method of operating a heat pipe according to claim 16, wherein the body is rotated with the magnet.

18. A method of operating a heat pipe according to claim 13, wherein the heat transfer of the heat pipe is reduced or turned off when the chemical heat pump working in a two-step process is charged by an external energy source.

19. The heat pipe according to claim 1, wherein the body is semi-cylindrical in shape.

* * * * *